US007137732B2

(12) United States Patent
Takeda

(10) Patent No.: US 7,137,732 B2
(45) Date of Patent: Nov. 21, 2006

(54) PORTABLE TIMEPIECE

(75) Inventor: Koremoto Takeda, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/007,472

(22) Filed: Dec. 8, 2004

(65) Prior Publication Data

US 2005/0141347 A1 Jun. 30, 2005

(30) Foreign Application Priority Data

Dec. 25, 2003 (JP) ..... 2003-430342

(51) Int. Cl.
*G04B 37/00* (2006.01)

(52) U.S. Cl. ..... 368/295; 368/294

(58) Field of Classification Search ..... 368/294, 368/295

See application file for complete search history.

(56) References Cited

U.S. PATENT DOCUMENTS 6,599,009 B1 * 7/2003 Terasawa et al. ..... 368/295
6,821,014 B1 * 11/2004 Hiranuma et al. ..... 368/295

FOREIGN PATENT DOCUMENTS

JP 10239454 9/1998

* cited by examiner

*Primary Examiner*—Vit Miska
*Assistant Examiner*—Jeanne-Marguerite Goodwin
(74) *Attorney, Agent, or Firm*—Adams & Wilks

(57) ABSTRACT

A portable timepiece has a bezel rotatably disposed on a case body, and an elastically deformable gasket interposed between the case body and the bezel in an elastically deformed state to exert a frictional force on the case body and the bezel sufficient to maintain the bezel in a stationary rotational position though permitting the bezel to be manually rotated to any desired position by overcoming the frictional force. One or more lock members are movably disposed on the bezel and contact a slip-preventing part provided on the case body. A manually rotatable holding ring engages with the lock members and is rotatable in one direction to increase the contact pressure between the lock members and the slip-preventing part to thereby prevent unintended rotation of the bezel, and is rotatable in the other direction to decrease the contact pressure to thereby permit manual rotation of the bezel by overcoming the frictional force exerted by the elastically deformed gasket. In this manner, inadvertent rotation of the bezel is prevented by structure other than the gasket thereby preventing undue wear of the gasket.

12 Claims, 5 Drawing Sheets

PORTABLE TIMEPIECE

BACKGROUND OF THE INVENTION

1. Field of the Invention

The present invention concerns a portable timepiece such as wristwatch and pocket watch, and especially relates to a portable timepiece in which a bezel is rotatably attached to a case band.

2. Description of the Prior Art

The bezel rotatably attached to the case band of the portable timepiece can exhibit various functions by rotating it to be set to an optional position, and can contribute to increase 1n additive value of the portable timepiece.

Heretofore, there is known a wristwatch in which, in order to rotatably attach the bezel to the case band, a step part, to whose inner periphery there is attached a cover glass, is formed in an upper part outer periphery of the case band over its whole periphery, an annular protrusion is formed in an outer periphery of the step part, a protrusion which is formed in an inner periphery of the bezel rotatably fitted to the step part of the case band is engaged from below with the protrusion of the step part outer periphery part to thereby prevent the bezel from disengaging, and an O-ring is interposed between the bezel and the step part (refer to JP-A-10-239454 Gazette (paragraphs 0002–0005, FIG. 19–FIG. 23)).

In a constitution of the JP-A-10-239454 Gazette, since the O-ring is interposed between the bezel and the step part in order to smoothly rotate the bezel, it is easy to rotation-operate the bezel to a desired position. However, as to the bezel capable of being simply rotation-operated, since its force holding a stationary state with respect to the case band is weak, it is easy that the bezel is carelessly deviated from a rotated position set by a user with effort to a position not desired by the user by an unexpected external factor and a chance.

In view of this point, in a case where a frictional resistance force is increased by strengthening a gripping force of the O-ring, the careless or unintended rotation of the bezel can be suppressed. However, reversely to this, in a case where the user rotates the bezel, the rotation of the bezel becomes difficult and thus an operability becomes deteriorated.

The problem to be solved by the present invention is to provide a portable timepiece capable of suppressing the fact that the bezel is carelessly rotated and deviated, without impairing the rotation operability of the bezel.

SUMMARY OF THE INVENTION

In order to solve the above problem, in the present invention, an annular bezel is rotatably disposed around an annular protrusion part of a case band, an annular gasket made of an elastic material, which makes the bezel stationary to a desirable rotated position with respect to the bezel, is interposed between the bezel and the case band under a state giving a frictional force to these, and a holding mechanism which holds the bezel to a stationary state with respect to the bezel and can release this holding state is provided separately from the gasket.

In this invention, there is possessed the holding mechanism which holds the bezel rotated by a user to a desired position with respect to the case band to the stationary state at the rotated position. By operating this holding mechanism to thereby exhibit a holding function, it is possible, by restricting the bezel rotated to the desired position, to suppress the fact that this bezel is carelessly rotated by an unexpected external factor and the like to thereby cause a positional deviation. And, in a case where a holding state which makes the bezel stationary is released by operating the holding mechanism, it is possible to rotation-operate the bezel to the desirable rotated position under this released state. By this, it becomes unnecessary to stop the rotation of the bezel by increasing a frictional resistance force of the gasket. Accordingly, since a frictional resistance of the gasket against the rotating operation of the bezel is small, it is possible to move the bezel to the desired position by being lightly rotated.

Further, in a preferred mode of the present invention, the holding mechanism possesses a slip-preventing part provided in the case band, a lock member movably provided in the bezel so as to contact with the slip-preventing part, and a holding ring which has an operating face pressing the lock member to the slip-preventing part and is provided so as to be capable of performing a rotating operation. For this reason, by the rotating operation of the holding ring, the lock member can be moved with respect to the bezel through an operating face of the holding ring. With this, it is possible to exhibit a holding function which holds the bezel to the stationary state with respect to the case band by pressing the lock member to the slip-preventing part. Conversely to this, by releasing the pressing by the rotating operation of the holding ring, the function of holding the bezel to the stationary state is released and thus the bezel is made possible to be rotation-operated. It is preferable in a point that the holding mechanism can be operated by the simple rotating operation of the holding ring.

Further, in a preferred mode of the present invention, since the holding ring is rotatably supported by the case band, it is preferable in a point that the rotation of the holding ring for making the bezel stationary to the desired position is suppressed from being transmitted to the bezel and thus the bezel is not rotated carelessly.

Further, in a preferred mode of the present invention, since the slip-preventing part is formed by a knurled face provided in the case band, it is preferable in a point that a rotation resistance for making the bezel stationary to the desired position can be obtained in such a manner that the lock member does not slip along the case band, without especially requiring a slip-preventing member.

Further, in a preferred mode of the present invention, since the slip-preventing part is formed by a hard rubber fixed to the case band, it is preferable in a point that, by obtaining a large frictional resistance between the slip-preventing part and the lock member, the rotation resistance for making the bezel stationary to the desired position can be obtained in such a manner that the lock member does not slip along the case band.

Further, in a preferred mode of the present invention, since the holding mechanism has a biasing body which biases the lock member toward the holding ring, it is preferable in a point that, as a holding state of the bezel by the holding mechanism is released, the lock member cab be surely separated from the slip-preventing part and, by this, the lock member can be made so as not to become a hindrance of the rotation when the bezel is rotation-operated.

BRIEF DESCRIPTION OF THE SEVERAL VIEWS OF THE DRAWINGS

A preferred form of the present invention is illustrated in the accompanying drawings in which.

DETAILED DESCRIPTION OF THE PREFERRED EMBODIMENTS

A first embodiment of the present invention is explained with reference to FIG. 1–FIG. 3.

Figure 1:
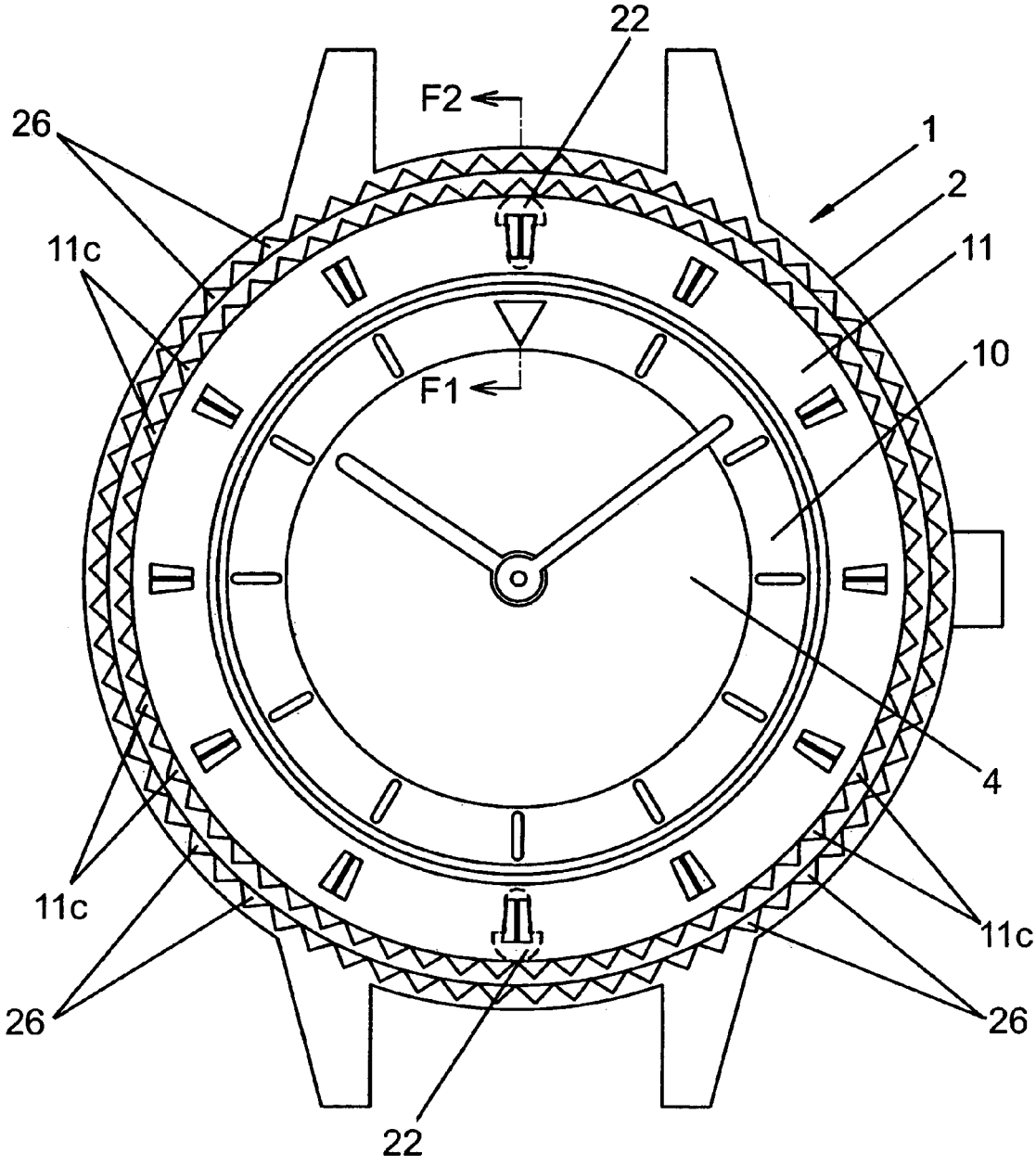
FIG. 1 is a plan view showing a wristwatch according to a first embodiment of the present invention.

In FIG. 1, a reference numeral 1 denotes a portable timepiece, for example, a wristwatch used by being mounted on an arm. Inside a timepiece exterior packaging assembly 2 that the wristwatch 1 possesses, there are accommodated a dial 10, a timepiece movement not shown in the drawing, and so forth. As shown in FIG. 2, the timepiece exterior packaging assembly 2 possesses a case body in the form of a case band 3 which is annularly made of a metal or a hard synthetic resin and the like. A cover glass 4 is liquid-tightly mounted to one face (front face) in a thickness direction of the case band 3, and a case back (not shown in the drawing) is detachably mounted to the other face (back face) in the thickness direction of the case band 3. The dial 10 is visible through the cover glass 4.

Figure 2:
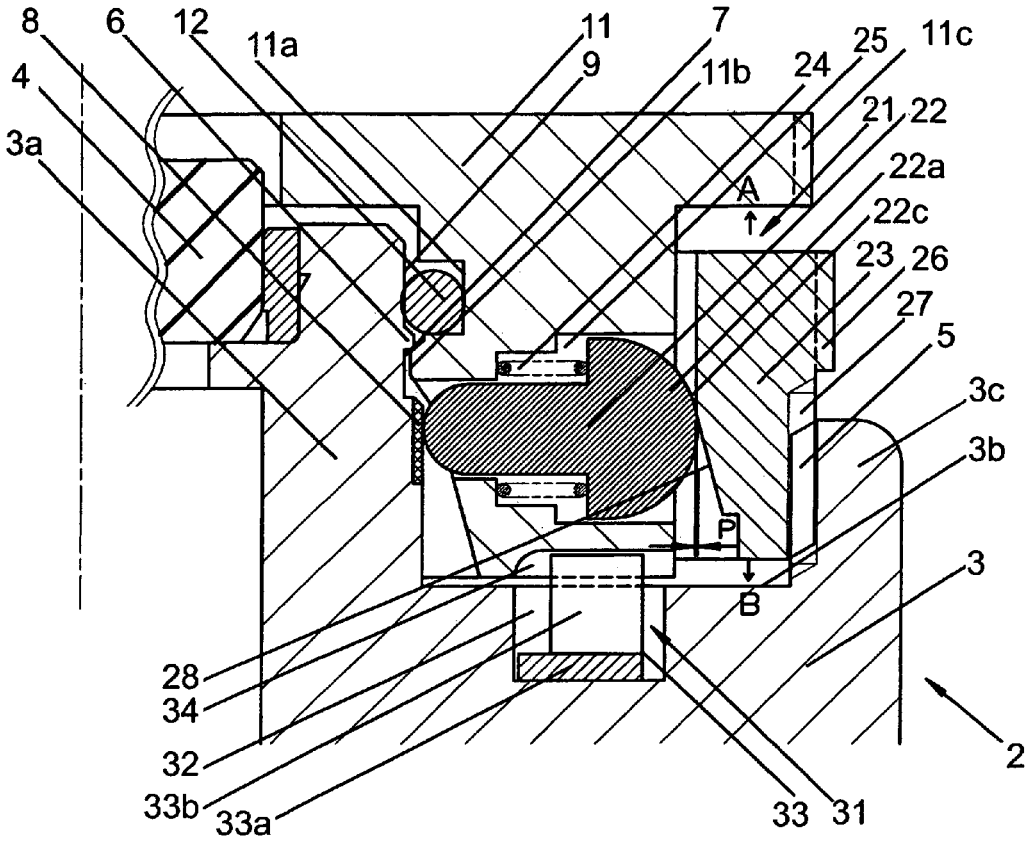
FIG. 2 is a sectional view showing a holding mechanism surrounding along a line F2—F2 in FIG. 1.

As shown in FIG. 2, the case band 3 has, in its front side, an annular protrusion part 3*a*, an annular exterior packaging shoulder face 3*b* continuous at approximately right angle to a base end of the annular protrusion part 3*a*, and a ring-supporting part 3*c* continuous to the exterior packaging shoulder face 3*b*. The cover glass 4 is mounted to an inner periphery of the annular protrusion part 3*a*. The ring-supporting part 3*c* is protrusively formed, for example, concentrically with and in the same direction as the annular protrusion part 3*a* and, in its inner periphery face, there is formed a female thread part 5.

In an outer periphery face of the annular protrusion part 3*a*, there are formed a protrusion 6, an escape groove 7, and a slip-preventing part 8 for a later-mentioned holding mechanism 21, all of which are annularly continuous along their circumferential direction. The outer periphery face of the annular protrusion part 3*a*, located in a tip end side of the annular protrusion part 3*a*, is used as a gasket-receiving face 9 with the protrusion 6 being made a boundary. The escape groove 7 is formed in a side opposite to the gasket-receiving face 9, i.e., in a base end side of the annular protrusion part 3*a*, with the protrusion 6 being made the boundary. The slip-preventing part 8 is located further in the base end side of the annular protrusion part 3*a* than the gasketreceiving face 9.

The slip-preventing part 8 is made of a knurled face which is formed by working knurled grooves to the outer periphery face of the annular protrusion part 3*a* with using a knurled tool. FIG. 3 exemplifies the slip-preventing part 8 in which the longitudinal knurled grooves extending in an axial direction while intersecting at right angle to the circumferential direction of the annular protrusion part 3*a* are provided with a constant interval in the circumferential direction of the annular protrusion part 3*a*. Since the slip-preventing part 8 is formed by the knurled face which is directly worked in the outer periphery of the annular protrusion part 3*a*, no slip-preventing member is required especially.

Incidentally, in place of this constitution, the slip-preventing part 8 may be provided in the outer periphery face of the annular protrusion part 3*a* by preparing, separately from the annular protrusion part 3*a*, a slip-preventing ring in whose outer periphery there are previously applied the knurled grooves, and fixing this slip-preventing ring to the outer periphery of the annular protrusion part 3*a* by a bonding using an adhesive, a welding or caulking, and the like.

As shown in FIG. 1 and FIG. 2, the timepiece exterior packaging assembly 2 possesses a bezel 11 which is rotatably attached to the case band 3 and functions as a decorative ring for instance. The bezel 11 is made of a metal or a synthetic resin etc. in an annular form, and rotatably disposed around the annular protrusion part 3*a*.

That is, as shown in FIG. 2, in an inner periphery of the bezel 11 there are provided, along this inner periphery, an annularly continuing groove ha and an engaging protrusion part 11*b*, and a gasket 12 is attached to the groove 11*a*. The gasket 12 is made in a ring-like form by an elastic material such as elastomer and synthetic resin. The bezel 11 is attached to the case band 3 by being fitted to an outer periphery of the annular protrusion part 3*a*. Under a mounted state of this bezel 11, the engaging protrusion part 11*b* enters into the escape groove 7 and is hooked to and engages with the protrusion 6, and the gasket 12 is interposed between the gasket receiving face 9 in the outer periphery of the annular protrusion part 3*a* and an inner periphery of the bezel 11. By an engagement of the protrusion 6 with the engaging protrusion part 11*b*, the bezel 11 is prevented from disengaging.

The gasket 12 is elastically deformed in order that the bezel 11 becomes stationary to a desirable rotated position with respect to the case band 3, thereby giving a frictional resistance force respectively to the outer periphery of the annular protrusion part 3*a* and the inner periphery of the bezel 11. In FIG. 1 and FIG. 2, a reference numeral 11*c* denotes irregularities, which are formed in an outer periphery face of the bezel 11, for preventing a finger from slipping. By engaging the finger with the irregularities 11*c* of the bezel 11 and thereby applying a rotation-operating force overcoming the aforesaid frictional resistance force to the bezel 11, this bezel 11 can be rotated and moved to a desired position.

The timepiece external packaging assembly 2 is provided with a holding mechanism 21 which holds the bezel 11 under its stationary state at an optional rotated position and can release this holding state when rotation-operating the bezel 11. As shown in FIG. 2, the holding mechanism 21 possesses the slip-preventing part 8, a lock member 22, a holding ring 23, and a biasing body, e.g., a coil spring 24.

That is, in at least one place, preferably plural places at the same interval in the circumferential direction of the bezel 11, for example two places corresponding to a radial direction of the bezel 11, stepped holes or openings 25 (only one is shown in FIG. 2) are opened along the radial direction of the bezel 11. A lock member 22 (only one is shown in FIG. 2) is inserted through each of these stepped holes 25. The fact that the lock members 22 are disposed in the plural places in the circumferential direction of the bezel 11 preferably at the same interval is preferable in a point that a balance is good because a prevention of a careless rotation of the bezel 11 by the lock member 22 is performed in the plural places along the circumferential direction of the bezel 11.

Figure 3:
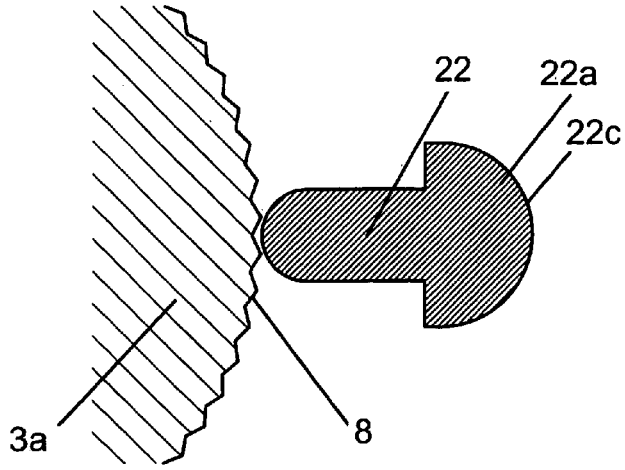
FIG. 3 is a sectional view showing a relation between a slip-preventing part and a lock member of the holding mechanism of FIG. 2.

The lock member 22 consists of a metal or a hard synthetic resin and, as shown in FIG. 2 and FIG. 3, has, e.g., a pin-like form in which the other end of a shaft-like main part whose one end contacts with the slip-preventing part 8 is provided with a head part 22*a* which is made larger, e.g., a larger diameter, than the main part. The lock member 22 is one functioning as a cam follower, and its head part 22*a* has a cam follower face 22*c*. This cam follower face 22*c* is made a hemispherical face for instance. An axial length of the lock member 22 is longer than the stepped hole 25.

Incidentally, the lock member 22 is not limited to the pin-like form, and its main part may have a plate shape extending in the circumferential direction of the bezel 11. For example, an end face of the lock member 22 that contacts with the slip-preventing part 8 may have a hemispherical shape. However, it is more preferable that, in place of this, the end face is configured as an arc-like face along the outer periphery face of the annular protrusion part 3*a* to thereby increase an area contacting with the slip-preventing part 8.

The holding ring 23 consists of a metal or a hard synthetic resin, and its outer diameter is larger than a maximum diameter of the bezel 11. As shown in FIG. 2, in an outer periphery part of the holding ring 23 there are formed irregularities 26 for preventing the finger from slipping and a male thread part 27 while their positions being deviated in the thickness direction of this ring 23. The male thread part 27 of the holding ring 23 is meshed with the female thread part 5 of the case band 3. The holding ring 23 is attached so as to be movable in the thickness direction of the case band 3 by changing this meshing state. Under this attached state, in order that a rotating operation of the holding ring 23 can be performed while suppressing an interference with the bezel 11, the irregularities 26 are located further radially outwardly than the irregularities 11*c* of the bezel 11.

In an inner periphery of the holding ring 23, there is formed, e.g., a slanted cam face 28 as an operating face contacting with the head part 22*a* of the lock member 22. This cam face 28 is continuous in the circumferential direction. The lock member 22 is adapted such that, when the holding ring 23 is rotation-operated in a clamping direction so as to approach the external packaging shoulder face 3*b*, the lock member 22 is pressed to the slip-preventing part 8 by the cam face 28. Incidentally, in FIG. 2, a reference mark P exaggeratively denotes an axial direction moving dimension which is given to the lock member 22 by the holding ring 23.

A coil spring 24 is interposed between a step part of the stepped hole 25 and the head part 22*a* of the lock member 22 under a compressed state. By the coil spring 24, the lock member 22 is biased toward the holding ring 23 such that the head part 22*a* of the lock member 22 maintains the contact with the cam face 28.

In FIG. 2, the reference numeral 31 denotes a moderation-exerting mechanism. This moderation-exerting mechanism 31 comprises a plate spring 33 accommodated in an annular groove 32 formed in the case band 3 while being opened to its external packaging shoulder face 3*b*, and locking concave parts (only one is shown in the drawing) 34 formed in a back face of the bezel 11 along its circumferential direction at every constant interval. The plate spring 33 has spring pieces 33*b* slantingly cut and raised from plural places of an annular part 33*a* fixed to the groove 32. A tip part of the spring piece 33*b* is engaged with and disengaged from the locking concave part 34 while accompanying with an elastic deformation of the spring piece 33*b*, thereby being capable of giving a click feeling to the rotation operation of the bezel 11. Incidentally, by taking shapes of the tip part of the spring piece 33*b* and the locking concave part 34 into consideration, it is also possible to regulate the rotation of the bezel 11 under the state of being exerted the moderation to one direction and, further, to allow the rotation in both directions. Further, it is also possible to omit the moderation-exerting mechanism 31.

In the wristwatch 1 having the above constitution, the holding ring 23 is moved in an arrow A direction in FIG. 2 by manually rotating the holding ring 23 in a loosening direction, i.e., a screw-out direction. With this, the lock member 22 is pressed back by the coil spring 24, and a state is reached in which the cam face 28 of the holding ring 23 does not press the lock member 22 to the slip-preventing part 8 of the case band 3, i.e., the contact pressure between the lock member 22 and the slip-preventing part 8 is decreased. In other words, the fact that the bezel 11 under the stationary state is held (fixed) under the stationary state by the holding mechanism 21 is released, so that the bezel 11 becomes in a manually rotatable state.

Accordingly, under this rotatable state, it is possible to rotation-operate the bezel 11 to the desirable rotated position with respect to the case band 3 while resisting against the frictional resistance force given by the gasket 12 and the moderation-exerting mechanism 31. After this rotating operation, by rotation-operating the holding ring 23 of the holding mechanism 21 in the clamping direction, the bezel 11 having been rotated to the desirable position can be held under the stationary state so as not to be moved from that position.

That is, the holding ring 23 moves in an arrow B direction in FIG. 2 by manually rotating the holding ring 23 in a tightening direction, i.e., a screw-in direction, so that it approaches the external packaging shoulder face 3*b* of the case band 3. For this reason, by the cam face 28 of the holding ring 23 contacting with the head part 22*a* of the lock member 22, the lock member 22 is pressed to the slip-preventing part 8 in the outer periphery of the annular protrusion part 3*a* thereby increasing the contact pressure between the lock member 22 and the slip-preventing part 8. This pressed state is maintained so long as the holding ring 23 is not loosened, by the fact that the holding ring 23 is supported while meshing with a ring-supporting part 3*c* of the case band 3.

In the final stage of screwing-in the holding ring 23 in order to fix the bezel 11 in the desired position, a large operating force is applied to the holding ring 23. However, notwithstanding this, since the holding ring 23 is supported by being meshed with the ring-supporting part 3*c* of the case band 3, the rotation operating force given to the holding ring 23 is exerted on the case band 3 but not transmitted to the bezel 11. By this, there is no fear that the bezel 11 is carelessly or accidentally rotated.

Under this state, the lock member 22 is interposed between the slip-preventing part 8 and the holding ring 23 and the lock member 22 is strongly pressed to the slip-preventing part 8, i.e., at a strong contact pressure. For this reason, in a case where an external force which tends to rotate the bezel 11 is applied to it without being desired, the lock member 22 which is suppressed from being deviated in the circumferential direction becomes a stopper by the rotation resistance in the slip-preventing part 8, so that the bezel 11 is suppressed form carelessly deviating in the circumferential direction of the case band 3.

Like the above, by exhibiting the holding function of the holding mechanism 21 thereby to restrict rotation of the bezel 11 from the desirable position, it is possible to suppress the bezel 11 from being carelessly rotated to thereby cause positional deviation and, in the case where the holding state which makes the bezel 11 stationary is released by reducing the holding function owing to the holding mechanism 21, it is possible to rotate the bezel 11 to the desirable rotated position under this released state. In these operations, in order to operate the holding mechanism 21, since it suffices if its holding ring 23 is rotation-operated, the operations are simple.

By possessing the holding mechanism 21 of the above constitution, it is unnecessary to excessively increase the frictional resistance force of the gasket 12 in order that the bezel 11 is not rotated carelessly. By this, it is possible to reduce the frictional resistance force of the gasket 12 against the rotating operation of the bezel 11. Accordingly, it is possible to move the bezel 11 to the desired position by lightly rotating it.

In this case, since the lock member 22 is biased toward the holding ring 23 by the coil spring 24, in accompaniment with the fact that the fixed state in which the bezel 11 is held in the stationary state is released, the lock member 22 can be surely separated from the slip-preventing part 8. For this reason, when the bezel 11 is rotation-operated, it is possible that the lock member 22 does not become a hindrance of the rotation.

Figure 4:
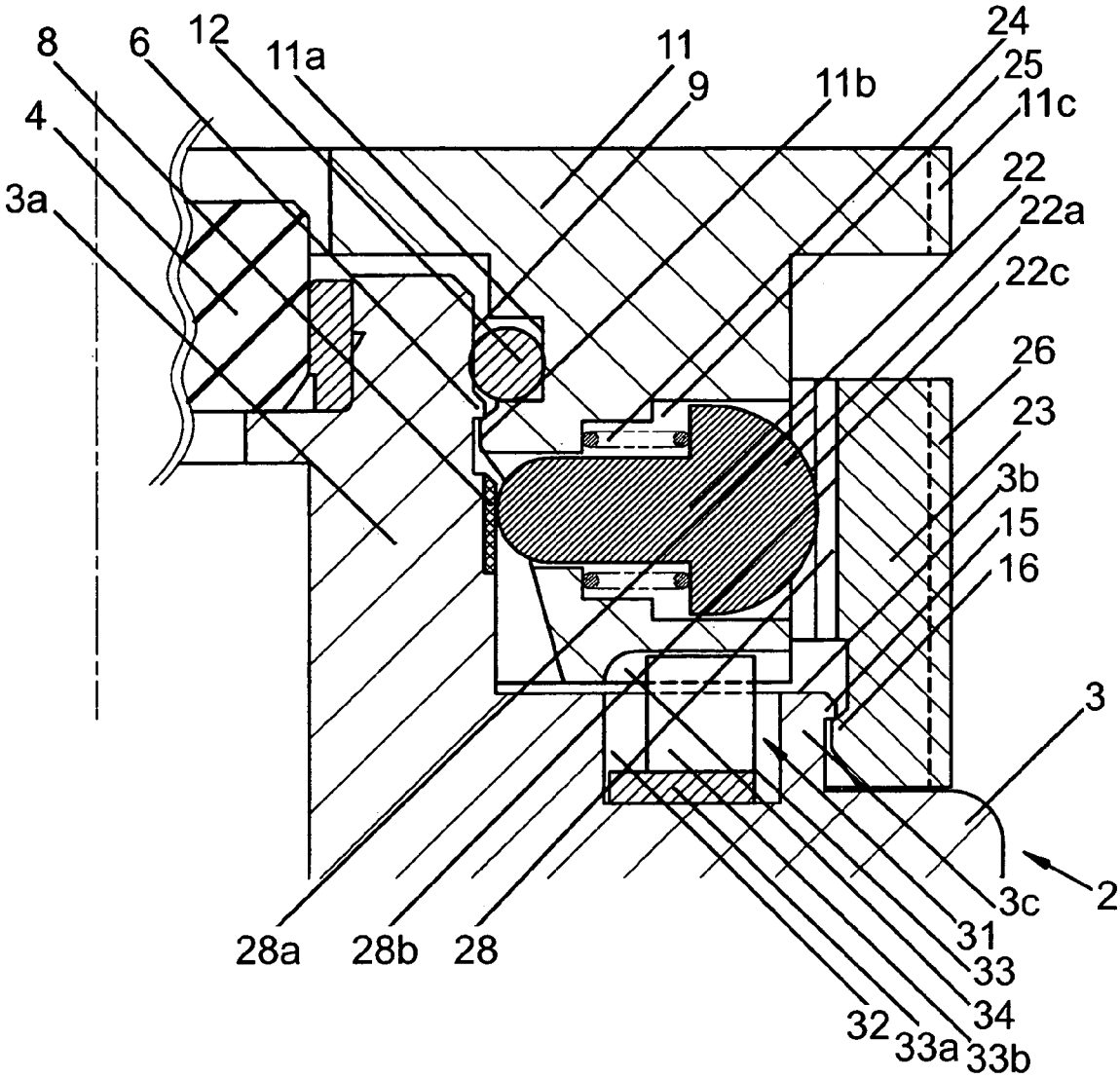
FIG. 4 is a sectional view, which corresponds to FIG. 2, showing the holding mechanism surrounding of a wristwatch according to a second embodiment of the present invention.
Figure 5:
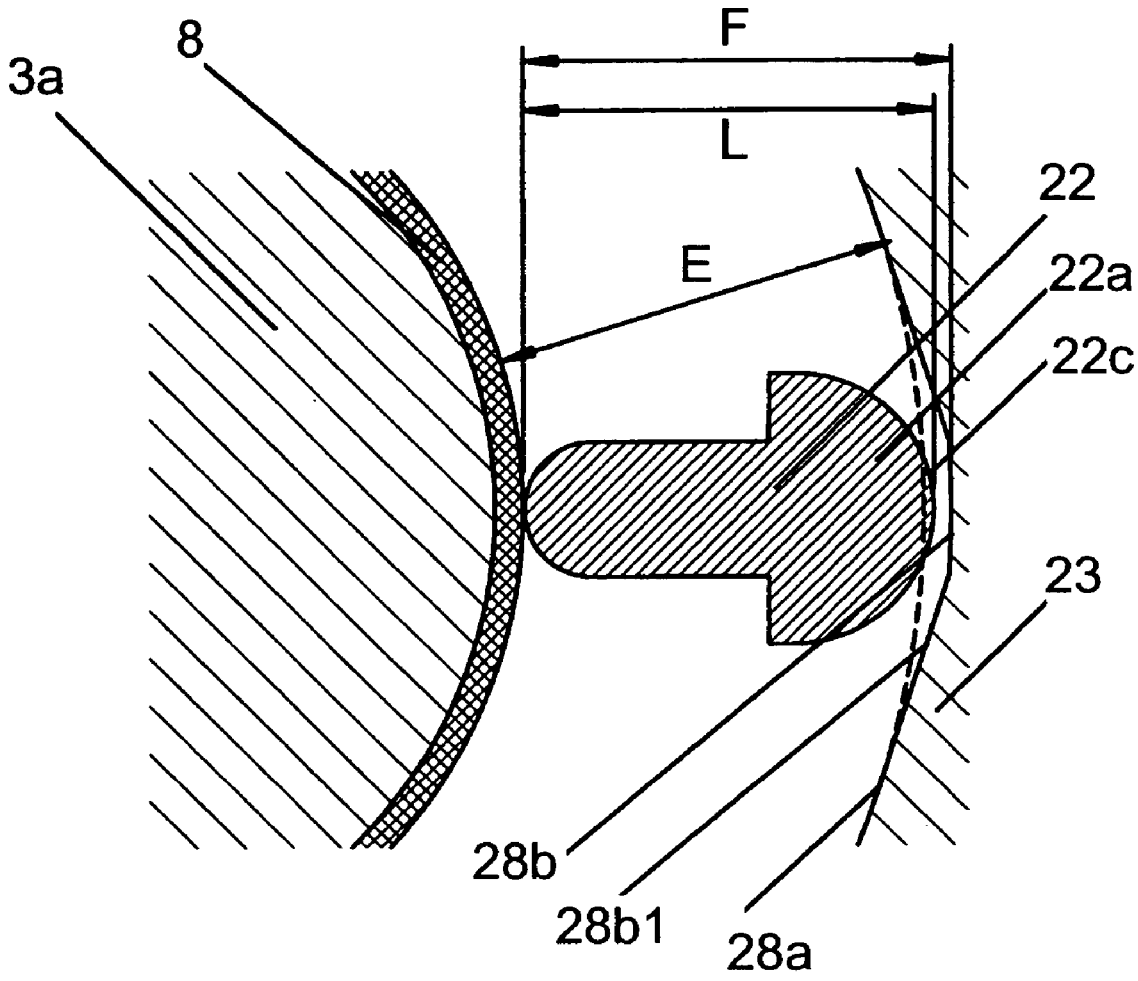
FIG. 5 is a sectional view showing a relation between a slip-preventing part and a lock member of the holding mechanism of FIG. 4.

FIG. 4 and FIG. 5 show a second embodiment of the present invention. Since this embodiment is basically the same as the first embodiment, the same reference numeral is applied to a portion having the same constitution or the same function, and explanation thereof is omitted. Hereunder, portions different from the first embodiment are explained.

In the second embodiment, the slip-preventing part 8 is formed by a hard rubber layer which is fixed by bonding and the like to an outer periphery of the annular protrusion part 3*a* of the case band 3. The fact that the slip-preventing part 8 made of the rubber is used like this is preferable in a point that a large rotation resistance for making the bezel 11 stationary in the desired position because a large frictional resistance can be obtained between it and the lock member 22.

Further, in the second embodiment, the ring-supporting part 3*c* is formed by a step part depending from the external packaging shoulder face 3*b* and has, in a standing face of this step part, a protrusion 15 continuous in the circumferential direction. The holding ring 23 has, in its inner periphery face, an engaging protrusion part 16 together with the cam face 28 functioning as the operating face. The engaging protrusion part 16 is continuously provided along the circumferential direction of the holding ring 23 and hooked by the protrusion 15 from below in FIG. 4, thereby preventing the holding ring 23 from disengaging. The protrusion 15 and the engaging protrusion part 16 are ones provided in place of the male thread part and the female thread part which mutually mesh in the first embodiment. The holding ring 23 is provided rotatably in the circumferential direction. Incidentally, the rotation of the holding ring 23 may be limited only to a predetermined angle.

As shown in FIG. 5, the cam face 28 provided in the inner periphery face of the holding ring 23 comprises an arc face 28*a* depicted by the same radius and an escape face 28*b* which has a slanted face 28*b*1 continuous to this arc face 28*a* and in which one part of the inner periphery face of the holding ring 23 is concaved. A separation distance E along a radial direction of the case band 3 between the slip-preventing part 8 and the arc face 28*a* is set shorter than a total length L of the lock member 22 in such a degree as to be enough to sufficiently press the lock member 22 to the slip-preventing part 8. A separation distance F along the radial direction of the case band 3 between the slip-preventing part 8 and a deepest portion of the escape face 28*b* is set longer than the total length L of the lock member 22.

Owing to such a dimensional relation, under a state that the arc face 28*a* of the cam face 28 contacts with the head part 22*a* of the lock member 22 by the rotating operation of the holding ring 23, the lock member 22 approaches the annular protrusion part 3*a* and is strongly pressed to the slip-preventing part 8. For this reason, by restricting rotation of the bezel 11 from the desired position, it is possible to suppress the bezel 11 from being carelessly rotated and causing positional deviation. Further, under a state that the head part 22*a* of the lock member 22 is disposed in the deepest part of the escape face 28*b* of the cam face 28 by the rotating operation of the holding ring 23, the lock member 22 is moved by the biasing force of the coil spring 24 such that its head part 22*a* contacts with the deepest part of the escape face 28*b*. For this reason, it is possible to make the lock member 22 into a state of lightly contacting with the slip-preventing part 8 or to separate the lock member 22 from the slip-preventing part 8.

A constitution other than the point explained above is the same as the first embodiment, including a constitution not shown in FIG. 4 and FIG. 5. Accordingly, also in this second embodiment, the problem of the present invention can be solved by obtaining the actions similar to the first embodiment. Moreover, when rotation-operating the holding ring 23, since a small rotating amount is suffices, it is preferable. Additionally, in the second embodiment, since the holding ring 23 is supported in its inside by the ring-supporting part 3*c*, the irregularities 26 can be provided over the whole outer periphery of the holding ring 23. For this reason, since the engagement of the user's finger with respect to the holding ring 23 becomes good and a rotating operability of the holding ring 23 can be improved, it is preferable.

Figure 6:
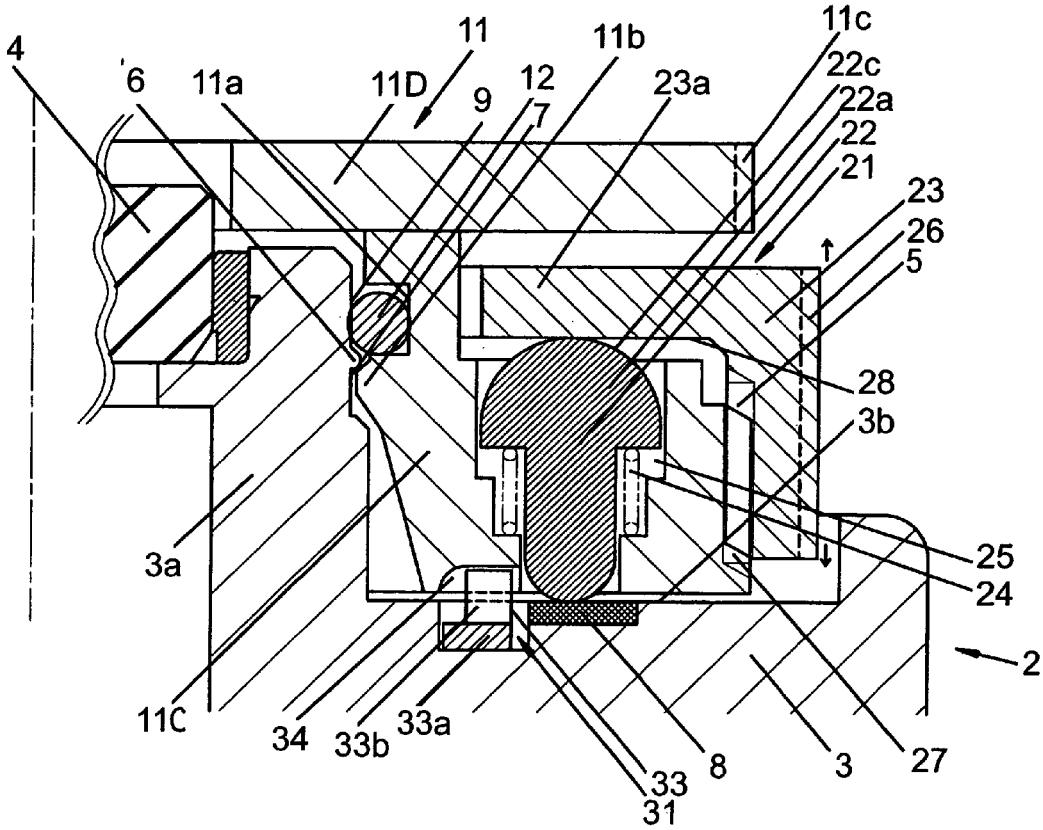
FIG. 6 is a sectional view, which corresponds to FIG. 2, showing the holding mechanism surrounding of a wristwatch according to a third embodiment of the present invention.

FIG. 6 shows a third embodiment of the present invention. Since this embodiment is basically the same as the first embodiment, the same reference numeral is applied to a portion having the same constitution or the same function, and explanation thereof is omitted. Here under, portions different from the first embodiment are explained.

In the third embodiment, the bezel 11 has a bezel body 11C, and a bezel plate 110 fixed to the former from a front side. The bezel plate 110 having the irregularities 11*c* in its outer periphery part is fixed to the bezel body 11C after the holding ring 23 has been attached to the bezel body 11C. In the bezel body 11C there is provided the stepped hole 25 penetrating through in its thickness direction. The bezel body 11C is one functioning also as the ring-supporting part and, therefor, the male thread part 27 is formed in an outer periphery part of the bezel body 11C. The female thread part 5 possessed by the holding ring 23 is meshed with the bezel body 11C, not the case band 3. For this reason, by rotating the holding ring 23, this holding ring 23 is moved along the thickness direction of the bezel 11.

The holding ring 23 has an annular presser part 23*a* protruding to an inside of the former. This presser part 23*a* enters into between a face to which an upper end of the stepped hole 25 of the bezel body 11C opens and the bezel plate 11D. The operating face 28 consisting of a flat annular face, which is possessed by this presser part 23*a*, contacts with the head part 22*a* of the lock member 22 inserted into the stepped hole 25. Further, the annular slip-preventing part

8 is provided in the external packaging shoulder face 3*b* of the case band 3. This slip-preventing part 8 consists of a rubber material etc. for instance, and is embedded and fixed in a groove provided in the external packaging shoulder face 3*b*. Incidentally, it is also possible to form the slip-preventing part 8 with the knurled face.

Like the above, by the relation in which the holding mechanism 21 is provided so as to extend along the thickness direction of the bezel 11 and the case band 3, the ring-supporting part is not provided in the case band 3. Further, the moderation-exerting mechanism 31 giving the click feeling to the rotating operation of the bezel 11 regulates the rotation of the bezel 11 under the moderation-exerting state to the rotation in one direction in view of shapes of the tip part of the spring piece 33*b* and the locking concave part 34. This rotation regulation is for not allowing the rotation of the bezel 11 when the holding ring 23 is rotation-operated so as to approach the external packaging shoulder face 3*b*. By this, it is adapted such that the position of the bezel 11 is prevented from deviating in accompaniment with the rotating operation which finally, strongly screws in the holding ring 23 to thereby carelessly rotate the bezel 11.

A constitution other than the point explained above is the same as the first embodiment, including a constitution not shown in FIG. 6. Accordingly, also in this third embodiment, the problem of the present invention can be solved by obtaining the actions similar to the first embodiment. Additionally, in the third embodiment, since the holding ring 23 is supported in its inside by the bezel 11, the irregularities 26 can be provided over the whole outer periphery of the holding ring 23. For this reason, since the engagement of the user's finger with respect to the holding ring 23 becomes good and the rotating operability of the holding ring 23 can be improved, it is preferable. Incidentally, in the third embodiment, in a case where such an escape face as explained in the second embodiment is provided in the operating face 28 of the presser part 23*a* of the holding ring 23, the rotation amount of this holding ring 23 can be reduced when rotation-operating the holding ring 23.

The present invention is not limited to the above-mentioned embodiments. For example, in the first embodiment, it is also possible to perform the operation by disposing the holding mechanism 21 vertically along the thickness direction of the bezel 11 and the case band 3 as explained in the third embodiment, and providing the holding ring 23 having the annular presser part 23*a* so as to be movable in the thickness direction of the case band 3 by being meshed with the thread part of the case band 3.

According to the present invention, since it is adapted such that the rotation of the bezel is restricted by the holding mechanism to thereby suppress the careless rotation of the bezel and the gasket does not bear a function which suppresses the rotation of the bezel, it is possible to provide a portable timepiece capable of suppressing the fact that the bezel is carelessly rotated and deviated, without impairing the rotation operability of the bezel.

What is claimed is:

1. A portable timepiece comprising:

a case body having an annular protrusion part to whose inner periphery there is attached a cover glass;

an annular bezel rotatably disposed around the annular protrusion part;

an annular gasket made of an elastic material and interposed between the bezel and the case body in a state giving a frictional force to the bezel and the case body to maintain the bezel in a desired rotated position with respect to the case body; and a holding mechanism which is provided separately from the gasket and which releasably holds the bezel in a stationary state with respect to the case body, the holding mechanism comprising a slip-preventing part provided in the case body, a lock member movably provided in the bezel so as to contact with the slip-preventing part, and a rotatable holding ring which has an operating face pressing the lock member to the slip-preventing part and capable of performing a rotating operation.

2. A portable timepiece as set forth in claim 1; wherein the holding ring is rotatably supported by the case body.

3. A portable timepiece as set forth in claim 1; wherein the slip-preventing part is formed by a knurled face provided in the case body.

4. A portable timepiece as set forth in claim 1; wherein the slip-preventing part is formed by a hard rubber fixed to the case body.

5. A portable timepiece as set forth in claim 1 wherein the holding mechanism has a biasing body which biases the lock member toward the holding ring.

6. In a portable timepiece having a case body: a bezel rotatably disposed on the case body; an elastically deformable gasket interposed between the case body and the bezel in an elastically deformed state to exert a frictional force on the case body and the bezel sufficient to maintain the bezel in a stationary rotational position on the case body though permitting the bezel to be manually rotated to any desired rotational position by overcoming the frictional force; a slip-preventing part provided on the case body; one or more lock members each movably disposed on the bezel so as to contact the slip-preventing part; and a manually rotatable holding ring engageable with the one or more lock members and rotatable in one direction to increase the contact pressure between the one or more lock members and the slip-preventing part to thereby prevent unintended rotation of the bezel and rotatable in the other direction to decrease the contact pressure between the one or more lock members and the slip-preventing part to thereby permit manual rotation of the bezel by overcoming the frictional force exerted by the elastically deformed gasket.

7. A portable timepiece according to claim 6; wherein the holding ring is threadedly engaged with the case body.

8. A portable timepiece according to claim 6; wherein the one or more lock members each has a cam follower face, and the holding ring has a cam face in sliding contact with each cam follower face.

9. A portable timepiece according to claim 6; further including a biasing body that biases each lock member toward the holding ring.

10. A portable timepiece according to claim 6; wherein the holding ring is rotatably supported by the case body.

11. A portable timepiece according to claim 6; wherein the slip-preventing part has a knurled face.

12. A portable timepiece according to claim 6; wherein the slip-preventing part is comprised of a hard rubber.

* * * * *